US005672094A

United States Patent [19]

Nishimura et al.

[11] Patent Number: 5,672,094

[45] Date of Patent: Sep. 30, 1997

[54] CENTRIFUGAL DRY BARREL FINISHING MACHINE

[75] Inventors: Kazutoshi Nishimura, Niwa-gun; Masatomo Watanabe, Hashima; Mikitoshi Hiraga, Iwakura, all of Japan

[73] Assignee: Sintobrator, Ltd., Nagoya, Japan

[21] Appl. No.: 651,331

[22] Filed: May 22, 1996

[30] Foreign Application Priority Data

May 23, 1995 [JP] Japan ..... 7-123936

[51] Int. Cl.[6] ..... B24B 31/00

[52] U.S. Cl. ..... 451/32; 451/35; 451/106; 451/113; 451/328; 451/456

[58] Field of Search ..... 451/32, 35, 104, 451/106, 113, 326, 327, 328, 329, 456

[56] References Cited

U.S. PATENT DOCUMENTS

| | | | |
|---|---|---|---|
| 3,078,623 | 2/1963 | Stanley | 451/329 |
| 4,638,600 | 1/1987 | Kobayashi et al. | 451/329 |
| 4,771,579 | 9/1988 | Giese | 451/456 |
| 5,454,749 | 10/1995 | Ohno | 451/329 |
| 5,476,415 | 12/1995 | Nishimura et al. | 451/326 |

FOREIGN PATENT DOCUMENTS

| | | |
|---|---|---|
| 57-75775 | 5/1982 | Japan . |

*Primary Examiner*—Eileen Morgan

*Attorney, Agent, or Firm*—Fish & Neave; Jeffrey H. Ingerman

[57] ABSTRACT

A centrifugal dry barrel finishing machine is disclosed. The machine include a plurality of barrel pots which are rotated about their axes of rotation and revolved about an axis of revolution. A mass is put in the barrel pots to finish workpieces by dry media that flows in the barrel pots. Each barrel pot has an air-intake part and an air and dust exhaust part that prevent the workpieces and dry media of the mass from passing through the parts, and the air and dust exhaust part is connected to and in communication with a dust collector through a connector device such that each barrel pot is rotatable and revolvable relative to said dust collector.

6 Claims, 5 Drawing Sheets

CENTRIFUGAL DRY BARREL FINISHING MACHINE

FIELD OF THE INVENTION

This invention relates to a centrifugal dry barrel finishing machine and method wherein a plurality of barrels are revolved round an axis of revolution while they are rotated about their axes of rotation, and wherein a mass comprised of media and workpieces to be finished by the media flows in the barrels.

DESCRIPTION OF THE PRIOR ART

Dry barrel finishing has been broadly carried out for mirror finishing or the like by putting dry media in barrel pots, which media is produced by coating natural fibers of plants with an abrasive compound. However, since such dry media does not have a sufficient power for strong abrasive machining, it is not suitable for processing that requires a great degree of abrading, such as removing burrs from and rounding workpieces. Thus wet barrel finishing, which requires a sewage treatment, and which may cause environmental pollution, has been mainly used for such processing. However, to eliminate such pollution, even for processing that requires a great degree of abrading, dry barrel finishing, which does not require sewage treatment, is desired recently. To satisfy the desire, improved dry media that enables dry barrel finishing for burring and rounding workpieces has been developed (for example, see Japanese Patent U [KOKOKU of Utility Model], 2-43652).

A centrifugal dry barrel finishing machine, which includes a plurality of barrel pots disposed in an abrading chamber, is disclosed in Japanese Patent A (KOKAI), 57-75775, wherein such improved media is put in the barrel pots, which rotate about their axes of rotation and revolve about an axis of revolution within the chamber, and wherein a part of the walls of each barrel pot is formed with a sieve to let escape heat and dust caused by the abrasive processing from inside the barrel pot. However, the barrel pot having a sieve does not sufficiently cool the mass in it, nor remove the dust, resulting in a color change of the workpieces due to the dust adhering to them and insufficient abrading due to the high temperature of the mass caused by its friction. Thus wet dry barrel finishing is still used for processing that requires a great degree of abrading, such as burring and rounding.

The purpose of this invention is to provide a centrifugal dry barrel finishing machine and method that sufficiently cools the mass and the barrel pots and evacuates the dust to the outside to eliminate the above drawbacks.

SUMMARY OF THE INVENTION

To the above end, an air flow is taken into rotatable and revolvable barrel pots of a centrifugal dry barrel finishing machine of the present invention so that it passes through the mass in the barrel pots and is evacuated outside the pots. The mass is cooled and remaining in the pots. Each barrel pot includes an air-intake part and an air-exhaust part. The air-exhaust part is a filter or sieve through which the exhaust air and dust can pass, but the mass, including workpieces and media, cannot pass. The centrifugal dry barrel finishing machine also includes a connecting duct that connects the air-exhaust part of each rotatable and revolvable barrel pot to a dust connector that sucks the exhaust air from the air-exhaust part of the barrel pot.

DESCRIPTION OF THE PREFERRED EMBODIMENTS

Figure 1:
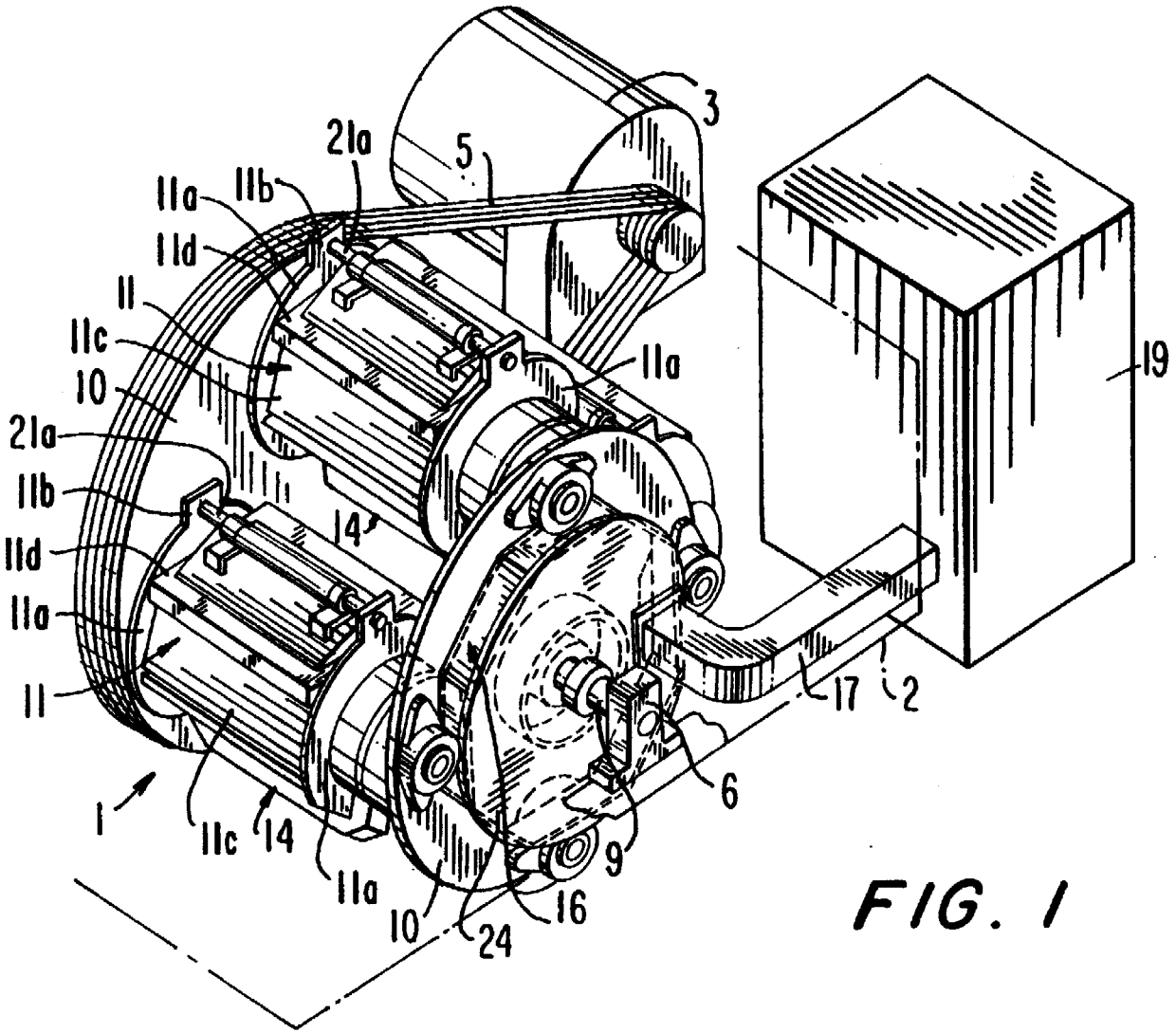
FIG. 1 is a perspective view of a first embodiment of a centrifugal dry barrel finishing machine of the present invention.
Figure 2:
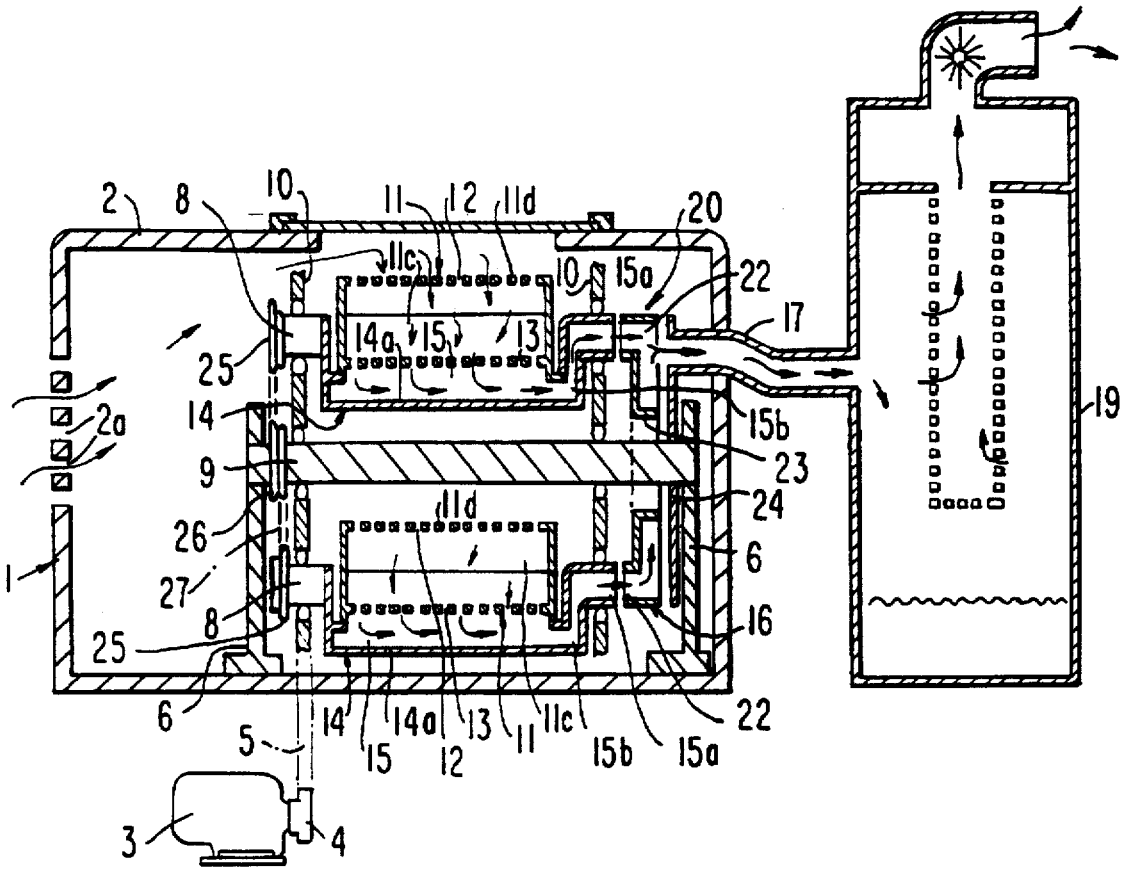
FIG. 2 is a sectional view of the centrifugal dry barrel finishing machine of FIG. 1.

In FIGS. 1 and 2 a first embodiment of the centrifugal dry barrel finishing machine is shown. The machine includes a main body 1, a motor 3, a connector device 20 (which includes connecting ducts 16 and I7), and a dust collector 19, which is connected to a vacuum source (not shown) at its upper part. The main body 1 includes a housing 2 and four barrel pots 11 disposed in the housing 2. The housing has an air-intake port 2*a*. The connecting duct 17 connects the barrel pots 11 to the dust collector 19 so that it communicates with the barrel pots 11. The barrel pots 11 are driven by the motor 3. The drive mechanism of the barrel pots is described below in detail.

A pair of upright supports 6, 6 are disposed in and secured to the housing 2. A shaft 9 is rotatably mounted on the supports 6, 6. A pair of turrets 10, 10, which are spaced apart, are fixedly mounted on the shaft 9. The turrets 10, 10 are rotated by the motor 3 by means of a power transmission belt 5 entrained on the output shaft of the motor 3 and one of the turrets 10, 10. The four barrel pots 11 are disposed between the turrets 10, 10 and are equidistantly spaced apart along the circumference of the turrets. Each barrel pot is rotatably mounted on the turrets through its shafts 8 located at the sides. As in FIG. 2, a sprocket 25 is attached to one shaft 8 located at one side of the barrel pot 11, while a sprocket 26 is mounted on one side of the shaft 9 of the turrets 10, 10. A chain 27 is entrained on the sprocket 26 and sprockets 25 of all the barrel pots 11 so that all the barrel pots 11 rotate clockwise about the axes of rotation of their shafts 8 when the turrets 10, 10 and the shaft 9 are revolved counterclockwise by the motor 3. Thus each barrel pot 11 rotates about its axis of rotation and revolves around its axis of revolution as a satellite.

Figure 3:
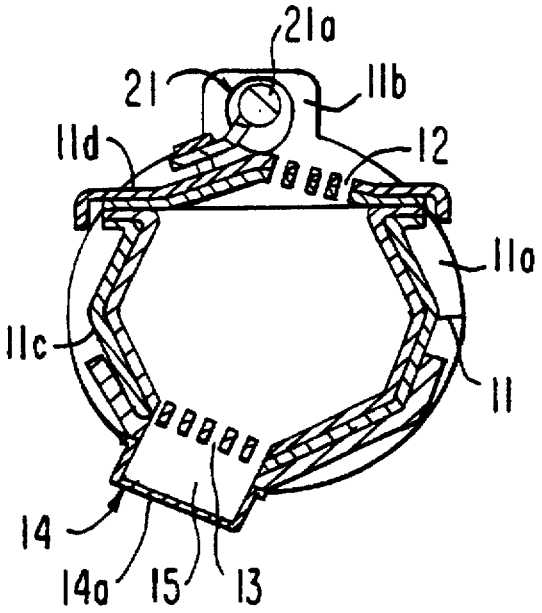
FIG. 3 is a front view of a barrel pot of the centrifugal dry barrel finishing machine of FIG. 1.

As in FIG. 3, each barrel pot 11 has a hollow cylindrical part 11*c* having an almost octagonal cross section. The sides of the barrel pot 11 are enclosed with circular side plates 11*a*, 11*a*, each having a tongue 11*b*. The barrel pot 11 has a first cover 11*d*, which is opened to put a mass in the pot 11. The cover 11*d* is closed and locked by a cam lock mechanism 21 (FIG. 4), which is attached to a shaft 21*a* mounted on the tongues 11*b*, 11*b* of the side plates 11*a*, 11*a*, and which is operated by a lever movement. The first cover 11*d* is formed with an air-intake part 12 (this part is omitted in FIG. 1 ) in a wall part (of eight wall parts) of the octagonal cylindrical part 11*c*, while an air-exhaust part 13 is formed in an opposing wall part. The air-intake part 12 and air-exhaust part 13 may be in the form of a filter, or a plurality of apertures or meshes. These apertures or meshes are small enough to prevent the mass from passing through them.

Figure 4:
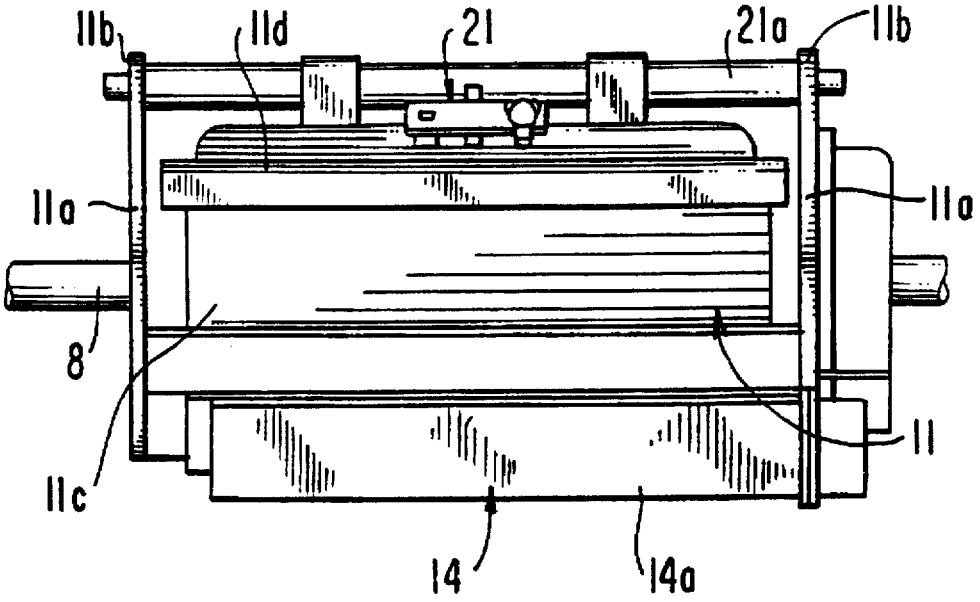
FIG. 4 is a cross-sectional view of the barrel pot of FIG. 3.

The air-exhaust part 13 of the barrel pot 11 is surrounded by a tray 14 having a second cover 14*a*, as in FIGS. 3 and 4. The second cover 14*a* provides a space 15 between itself and the air-exhaust part 13. This space 15 is a duct that communicates with the air-intake part 12 and the air-exhaust part 13 of the barrel pot 11 and the air-intake port 2a of the housing 2. Since the tray 14 is fixedly mounted on the pot 11, it rotates and revolves with the pot as a satellite. The shaft 8 of each barrel pot 11, which is located at one side of the pot 11 nearest the dust collector 19, is hollow, thereby providing a passage 15a for an air and dust flow. This passage 15a communicates with the space or duct 15 through a short duct portion 15b. The connector device 20 includes the intermediate connecting duct 16 and the connecting duct 17. The duct 17 is fixedly connected to the dust collector 19 at one end. The intermediate duct 16 is fixedly mounted on one of the turrets 10, 10. Thus it revolves with the turret 10 about the axis of revolution. The intermediate duct 16 includes a short annular duct part 23 and four connecting parts 22, which project from the annular duct part 23, and which are connected to the passages 15a of the barrel pots 11, for example, by swivel joints (not shown), such that these barrel pots can rotate relative to the intermediate duct 16. The intermediate duct 16 is also connected to the immovable duct 17, for example, by an annular swivel joint (not shown) such that the intermediate duct 16 can revolve relative to the duct 17 connected to the dust collector 19.

In the centrifugal dry barrel finishing machine configured as described above a mass of an appropriate volume is put in each barrel pot 11. Then the vacuum source (not shown) is operated to suck air from the outside of the housing 2 through the port 2a into all the barrel pots 11. Then the motor is driven to rotate and revolve the barrel pots like satellites. Due to this satellite movement of the pots wherein they rotate clockwise and revolve counterclockwise, the mass is subjected to a strong centrifugal force and flows along the inner wall of the pot, and workpieces are strongly abraded by the improved media having a high abrasive power. Therefore, burring or rounding workpieces can be carried out by the centrifugal dry barrel finishing machine. The air flows that entered the barrel pots from their air-intake parts 12 pass through the mass in the pots and carry a lot of dust caused by strong abrading of workpieces and go out of them through the air-exhaust parts 13, and pass through ducts 15, 15b, 15a, 20, 17 and the dust collector 19. When the air flows pass through the barrel pots, they also cool the mass and the barrel pots sufficiently.

Figure 5:
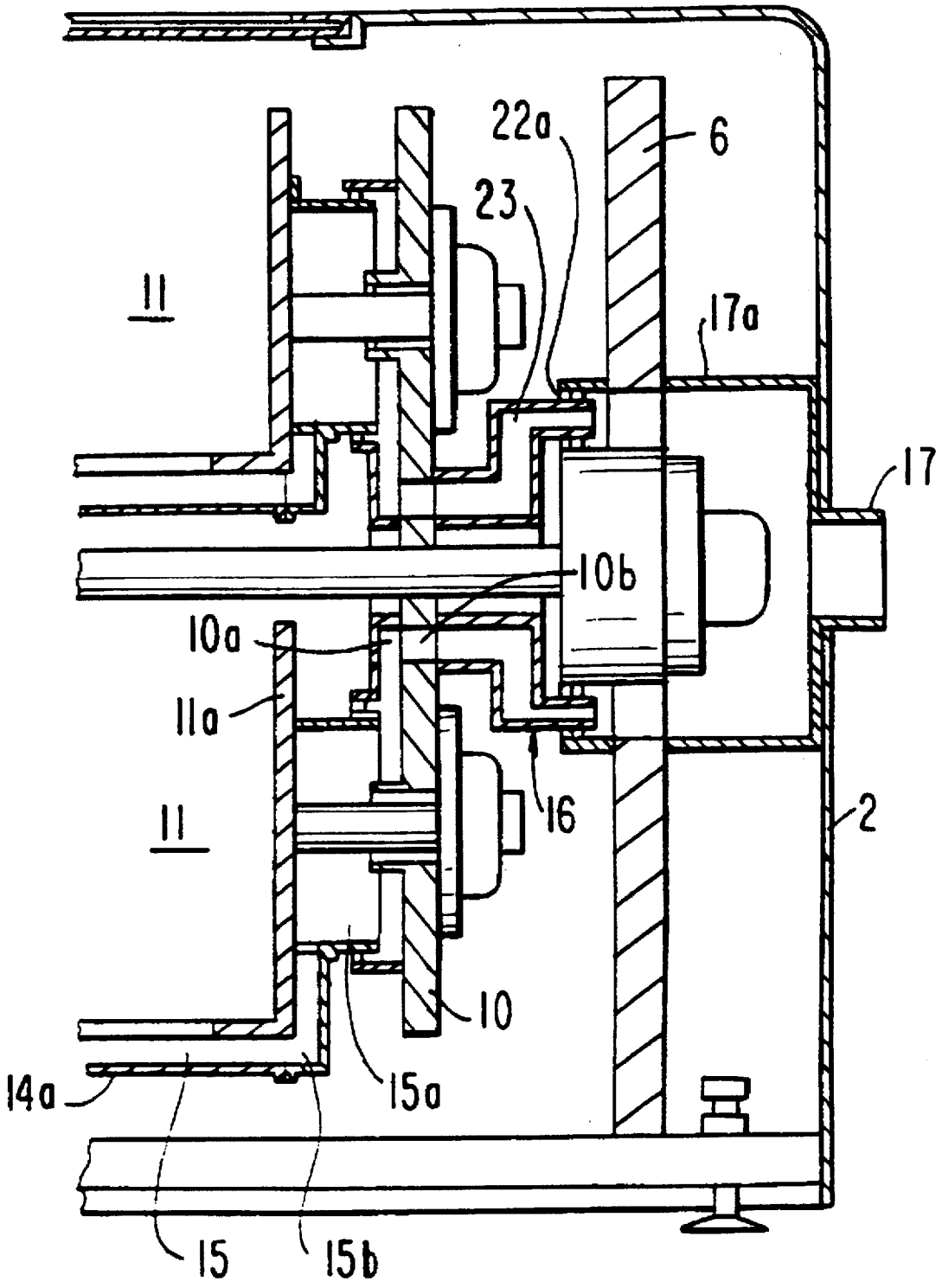
FIG. 5 is a cross-sectional view of an alternative connector device that connects the barrel pots to a dust collector of the centrifugal dry barrel finishing machine.

In FIG. 5 an alternative connector device is shown. It enables the intermediate duct 16 to be connected to the duct 17 at the central part of the turret 10, i.e., at the revolving shaft 9. The short annular duct part 23 of the intermediate duct 16 has an annular duct part 22a outwardly extending from the duct part 23. This annular duct part 22a is connected to the duct 17 by means of a swivel joint 17a, which is disposed at the shaft 9. This design enables air to be uniformly sucked from all the barrel pots 11.

Figure 6:
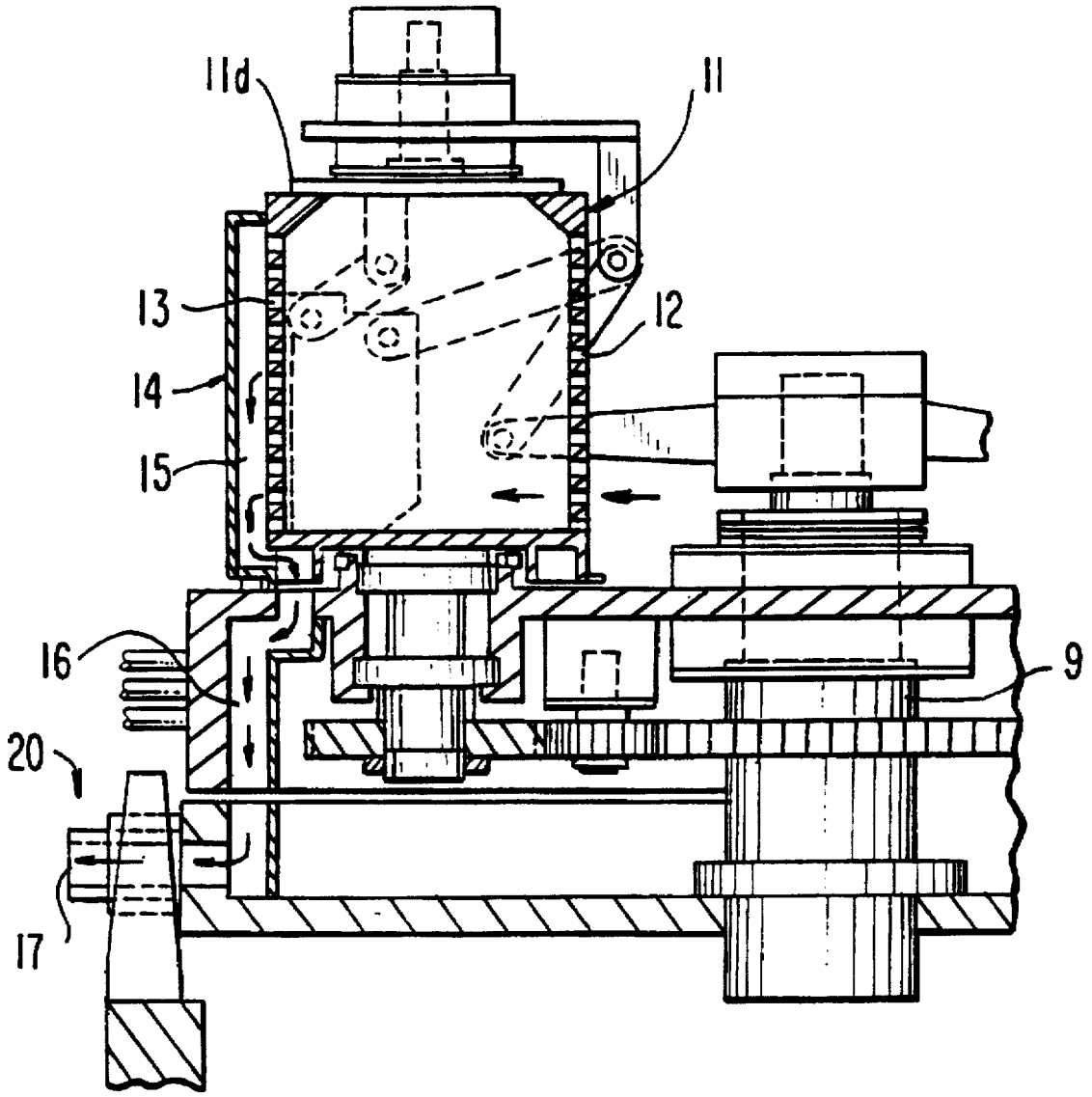
FIG. 6 is a second embodiment of the centrifugal dry barrel finishing machine, wherein the barrel pots are rotated and revolved about vertical axes.

In FIG. 6 a second embodiment of the centrifugal dry barrel finishing machine is shown. The machine is a horizontal type wherein a plurality of barrel pots 11 are horizontally revolved about a vertical revolving shaft 9 and rotated about their vertical axes. Each barrel pot 11 has an air-intake part 12 and an air-exhaust part 13 in its opposing vertical walls.

In the embodiments of FIGS. 5 and 6 the relative rotation between the passage 15 and the intermediate duct 16 and the relative rotation between the intermediate duct 16 and the duct 17 are the same as those in the embodiment of FIGS. 1 and 2.

Testing

The centrifugal dry barrel finishing machine of this invention and conventional machines were tested to compare their abilities. In the tests, four barrel pots, each having a capacity of eight liters, were used. They were rotated at the rate of 180 rpm with a radius of rotation of 226 min. Four liters of dry media, of RT10 from Sintobrator, Ltd., were used per barrel pot, and two cylindrical test pieces of brass, 22 mm in diameter and 15 mm long. The test results are as in Table 1. In the example of the machine of the present invention the area of the air-intake part and the air-exhaust part were respectively one eighth (1/8) of the total area of the walls of the pot. In comparative test 1, closed-type barrel pots were used. In comparative test 2, barrel pots, each having only an air-intake part, the area of which was one eighth (1/8) its total wall area, were used. The pots were disposed in a housing and the air in it was sucked by a dust collector.

TABLE 1

| | Example | Test 1 | Test 2 |
|---|---|---|---|
| Amount of abraded material (mg/h) | 250–270 | 170–190 | 180–210 |
| Rate of wear of media (%) | 0.4–0.6 | 0.3–0.5 | 0.5–0.7 |
| Amount of dust remaining in the pots (g) | 0 | 18 | 2 |
| Stains on test pieces | minimum | maximum | normal |
| Stains on the machine | none | many in pots | spattered in the housing |
| Temperature of mass (°C.) (1, 2, and 3 hours later) | 50 51 52 | 50 58 70 | 54 74 78 |

These effects of the invention as described above are seen from Table 1.

What we claim is:

1. A centrifugal dry barrel finishing machine for finishing workpieces, said machine comprising:

a plurality of barrel pots, each of said barrel pots having an axis of rotation and a mass inside, said mass comprising dry media and at least one workpiece;

means for rotating said barrel pots about their respective axes of rotation and for revolving said barrel pots about an axis of revolution for finishing said at least one workpiece during flow of said mass in the barrel pots, wherein each of said plurality of barrel pots further comprises:

an air-intake part and an air and dust exhaust part that prevents said at least one workpiece and the dry media from passing through said exhaust part and allows air received through said air-intake part and any dust produced during finishing to pass through said exhaust part;

a dust collector; and a connector device for connecting said exhaust part to said dust collector such that each barrel pot is rotatable and revolvable relative to said dust collector.

2. The machine of claim 1, wherein the connector device comprises:

a first duct connected to said air and dust exhaust part being rotatable and revolvable relative to said barrel pots;

an intermediate duct being revolvable about said axis of revolution; and a second duct having a first end and a second end, said first end being connected to said intermediate duct and said second end being connected to said dust collector.

3. A method for finishing workpieces using a centrifugal dry barrel finishing machine comprising the steps of:

rotating a plurality of barrel pots about their respective axes of rotation, each of said barrel pots having a mass comprising dry media and at least one workpiece;

revolving each of said barrel pots about an axis of revolution such that said mass flows inside the barrel pots, thereby finishing the workpieces, providing a dust collector in fluid communication with said barrel pots for receiving air and any dust produced during finishing of said workpieces, wherein each of said barrel pots is rotatable and revolvable relative to said dust collector; and passing said air flows through the mass.

4. A connector device for providing fluid communication between each of a plurality of barrel pots and a dust collector, each of said barrel pots being for receiving dry media and at least one workpiece therein and being rotatable about an associated axis of rotation and revolvable about one axis of revolution and each of said barrel pots having an exhaust part, said device comprising:

an immovable duct having a first end and a second end, said first end being connected to and in fluid communication with said dust collector;

a rotatable duct having a rotational axis, a first axial end, and a second axial end, wherein said duct rotational axis is substantially collinear with said axis of revolution and wherein said first axial end is rotatably mounted to and in fluid communication with said second end of said immovable duct; and a plurality of connecting parts for connecting and providing fluid communication between said exhaust parts of said barrel pots and said first axial end of said rotatable duct.

5. A centrifugal dry barrel finishing machine for finishing workpieces, said machine comprising:

a plurality of barrel pots for receiving a mass therein, said mass comprising dry media and at least one workpiece, each of said barrel pots having an axis of rotation;

means for rotating said barrel pots about their respective axes of rotation and for revolving said barrel pots about an axis of revolution for finishing said at least one workpiece during flow of said mass in the barrel pots, wherein each of said plurality of barrel pots further comprises:

an air-intake part and an air and dust exhaust part that prevents said at least one workpiece and the dry media from passing through said exhaust part and allows air received through said air-intake part and any dust produced during finishing to pass through said exhaust part;

a dust collector; and a connector device for connecting said exhaust part to said dust collector such that each barrel pot is rotatable and revolvable relative to said dust collector.

6. The machine of claim 5, wherein the connector device comprises:

a first duct connected to said air and dust exhaust part being rotatable and revolvable relative to said barrel pots;

an intermediate duct being revolvable about said axis of revolution; and a second duct having a first end and a second end, said first end being connected to said intermediate duct and said second end being connected to said dust collector.

* * * * *

UNITED STATES PATENT AND TRADEMARK OFFICE

CERTIFICATE OF CORRECTION

PATENT NO. : 5,672,094

DATED : September 30, 1997

INVENTOR(S) : Kazutoshi Nishimura et al.

It is certified that error appears in the above-indentified patent and that said Letters Patent is hereby corrected as shown below:

Column 1, line 36, "processing" should be --processing,--.

Column 4, line 6, "min." should be --mm.--.

Signed and Sealed this

Sixteenth Day of May, 2000

*Attest:*

Q. TODD DICKINSON

*Attesting Officer*

*Director of Patents and Trademarks*